US006106376A

United States Patent [19]

Rybak et al.

[11] Patent Number: 6,106,376

[45] Date of Patent: Aug. 22, 2000

[54] BULK METALLIC GLASS MOTOR AND TRANSFORMER PARTS AND METHOD OF MANUFACTURE

[75] Inventors: Tadeusz Rybak; Peter Georgopolos; Andrew Conroy, all of Adelaide, Australia

[73] Assignee: Glassy Metal Technologies Limited, Sydney, Australia

[21] Appl. No.: 08/765,294

[22] PCT Filed: Jun. 23, 1995

[86] PCT No.: PCT/AU95/00372

§ 371 Date: Dec. 20, 1996

§ 102(e) Date: Dec. 20, 1996

[87] PCT Pub. No.: WO96/00449

PCT Pub. Date: Jan. 4, 1996

[30] Foreign Application Priority Data

Jun. 24, 1994 [AU] Australia ..... PM6443

[51] Int. Cl.[7] ..... B24C 3/00

[52] U.S. Cl. ..... 451/75; 451/36; 451/38

[58] Field of Search ..... 451/39, 40, 75, 451/2, 3, 28, 36, 37, 38, 41, 60, 64, 91, 99

[56] References Cited

U.S. PATENT DOCUMENTS

| | | | |
|---|---|---|---|
| 3,526,162 | 9/1970 | Willcox . | |
| 4,298,382 | 11/1981 | Stempin et al. . | |
| 4,392,073 | 7/1983 | Rosenberry, Jr. . | |
| 4,529,458 | 7/1985 | Kushnick et al. . | |
| 4,711,056 | 12/1987 | Herrington et al. | 451/40 |
| 5,252,877 | 10/1993 | Sawa et al. . | |

FOREIGN PATENT DOCUMENTS

| | | |
|---|---|---|
| 89668/91 | 1/1993 | Australia . |
| 1136199 | 11/1982 | Canada . |
| 0214305 | 3/1987 | European Pat. Off. . |
| 2699852 | 7/1994 | France . |
| 61-58450 | 3/1986 | Japan . |
| 61-58451 | 3/1986 | Japan . |
| 61-285043 | 12/1986 | Japan . |
| WO 92/11116 | 7/1992 | WIPO . |

*Primary Examiner*—Derris Holt Banks
*Attorney, Agent, or Firm*—Baker & Maxham

[57] ABSTRACT

A method of bonding together metallic glass laminations to form a stack and thereafter shaping the stack, for example, by cutting, to form a bulk object such as a wound stator or rotor of an electric motor. Metallic glass is an amorphous ferromagnetic material used in the construction of electrical equipment to reduce core losses. The method involves coating individual laminations of metallic glass with a temperature resistant, non-gas producing metal bonding agent, stacking the coated laminations, applying a pressure to the stacked laminations such that the bonding agent does not exude from between the laminations, allowing the bonding agent to cure, and thereafter shaping the stacked laminations as required. In some cases, temperature resistant wiring and insulation are fitted to the shaped laminations and heated to a temperature sufficient to anneal the metallic glass. The laminations are shaped by cutting with a mixture of fluent material and abrasive material emitted from a nozzle at high pressure. The laminations or the nozzle are adjustable such that the outer surface of the cutting mixture is perpendicular to the plane of the surface of the laminations. The method can be employed for manufacturing other products, such as transformers, which can advantageously employ the ferromagnetic properties of metallic glass.

13 Claims, 10 Drawing Sheets

BULK METALLIC GLASS MOTOR AND TRANSFORMER PARTS AND METHOD OF MANUFACTURE

This is a 371 of PCT/AU95/00372 filed Jun. 23, 1995.

This invention relates to a method of producing bulk objects from thin ribbons of metallic glass including a means to cut the desired shape of the bulk object as well as a method of making and annealing uniquely shaped parts from the bulk object. The parts so manufactured are suitable for the manufacture of electric motors, transformers and other machines which can advantageously use the ferromagnetic properties of metallic glass.

BACKGROUND

"Metallic glass" is an amorphous ferromagnetic material. Such material can be used in the construction of electrical equipment to reduce core losses. The problems associated with forming bulk objects from thin metallic glass ribbons (sometimes referred to as amorphous ribbons) are described in U.S. Pat. No. 4,529,458 which teaches stacking the ribbon and consolidating the alloy under a pressure of at least 5895 kPa at a temperature of between 70% and 90% of the crystallisation temperature of the ribbon material for a time sufficient to facilitate bonding of the ribbons into a bulk object.

U.S. Pat. No. 4,529,458 also discloses other methods of forming bulk objects such as the method revealed in U.S. Pat. No. 4,298,382 involving hot pressing finely dimensioned bodies with forces of at least 6895 kPa in a non-oxidising environment at temperatures ranging from about 25° C. below the glass transition temperature to about 15% above the glass transition temperature for a period of time sufficient to cause the bodies to flow and fuse together into an integral unit.

The methods described have the following common steps:

Preheating the ribbons; bringing the ribbons into contact; compacting the block of ribbons and heat treating the bulk object to be formed.

Preheating the ribbons makes them brittle and very prone to damage, consequently material losses and production delays are common.

Even the finished bulk product of the process described above is relatively brittle, consequently breakages and imperfections are common.

Metallic glass blocks and ribbons are so hard that their shape cannot be easily or reliably changed by conventional cutting methods, even though a ribbon is flexible. Guillotine or blank die cutting methods stress and crack the blocks, laser and EDM cutting methods melt the metallic glass and create undesirable crystallisation which reduces the ferromagnetic properties of the material. Furthermore, some of these cutting methods create undesirable magnetic and electrical connections between laminated ribbons in the block which propagate undesirable eddy currents. Thus these cutting methods further reduce the ferromagnetic properties of laminated metallic glass blocks.

In some applications, the individual ribbon portions are heated to pre-anneal the material so that it will have good ferromagnetic properties when one or more strategically located strips of material are required in an electrical device. However, pre-annealing makes the ribbons very brittle.

The use of metallic glass (amorphous magnetic) ribbons annealed or un-annealed on stators and other parts of electric motors, either singly or in laminations, is common. For example, rotary electric machines like those described in Canadian Patent No 1136199 are made by adhering amorphous magnetic material ribbons to the stator core coil. Alternatively, a magnetic wedge can be fitted into the stator slot of the motor where the magnetic wedge consists of an amorphous magnetic ribbon adhered onto a non-magnetic, insulating sheet of the type described in U.S. Pat. No. 5,252,877.

However the methods described above for producing cores for rotors and stators is time consuming. Furthermore, the brittleness of the typically pre-annealed amorphous magnetic material results in high production losses.

Other ways of producing parts of electric and even servo-electric motors include winding wire shaped amorphous magnetic material around a cylindrical coil or producing a stator from one or two edge wound helices of amorphous magnetic ribbon as described in U.S. Pat. No. 4,392,073. These types of construction are not common because of high manufacturing costs.

Certain solid forms of motor cores can be moulded by mixing amorphous magnetic material in the form of flakes and short fibres with a thermosetting polymer binder. It is, however, recognised that the packing density of the amorphous material is not always consistent and sufficiently dense for desirable results.

To provide some of the conventional shapes of transformer coils and the like, stacks of ribbons are arranged into the desired shapes, however it is found that the final product does not perform as well as would a substantially solid or shaped metallic glass block cut to the conventional shape.

For example, the E| shaped core of a three phase transformer winding can be constructed using stacks of metallic glass ribbons. The E| shaped core is created by nesting and stacking rectangular blocks of laminated and treated ribbons in the shape depicted in FIG. 15. However, gaps still exist between the ends of the rectangular blocks and these gaps contribute to a decrease in the ferromagnetic characteristics of the object compared with a solid core of the same material which obviously does not have the gaps.

The advantages of substantially solid laminated amorphous magnetic material which has been annealed over conventional permanent magnet or iron core material include; reduced core loss; high permeability; high moments of inertia; high heat dissipation; less radio frequency emission in high speed motors that can be made without commutators and brushes; and in some motor designs substantially constant torque across the voltage and revolutions per minute range.

Therefore, it is desirable to have the advantages described and to overcome or avoid the abovementioned problems.

A method for manufacturing and annealing bulk metallic glass objects for use in electrical products such as those described above is described in this specification as well as a variety of electric motor components which become possible as a consequence of the use of the method.

SUMMARY OF THE INVENTION

A preferred method for producing bulk objects of metallic glass can be summarised by the following steps.

First, individual laminations of metallic glass are coated with a temperature resistant, non-gas producing metal bonding material. Second, one or more coated laminations are stacked to form a stack. Third, the stack is pressed with a pressure less that which would force the bonding material from between the laminations and for a period of time during which the bonding material cures. Fourth, the stack is formed by cutting or other suitable process into a shape suitable for its purpose. Fifth, the shaped stack is fitted with temperature resistant wiring and insulation. Sixth, the shaped stack and its fitted wiring is heated to a temperature sufficient to anneal the metallic glass.

In a further aspect of the invention the annealing temperature is preferably above the Curie temperature and below the crystallisation temperature of the metallic glass which is typically above 300° C. and below 460° C. respectively.

In a further aspect of the invention the wiring and insulation is resistant to temperature greater than 460° C.

In a yet further aspect of the invention the fitted and shaped stack is heated by applying a current through the fitted wiring where the current is sufficient to heat the stack to a temperature sufficient to anneal the metallic glass.

In a further aspect of the method of cutting a stack of individual laminations of metallic glass, a cutting medium is emitted from a nozzle, wherein the nozzle or the stack of laminations is adjustable so that the outer surface of the cutting medium is directed along a path perpendicular to the plane of a surface of the stack of metallic glass laminations.

DETAILED DESCRIPTION OF AN EMBODIMENT OF THE INVENTION

Figure 1:
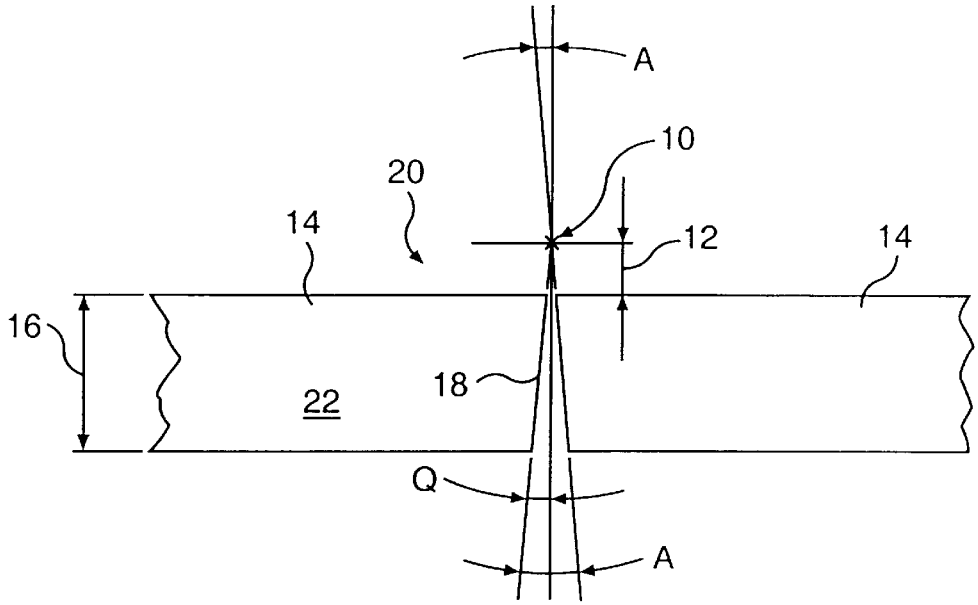
FIG. 1 PRIOR ART
FIG. 1 is a pictorial representation of a cut made with a conventional cutting apparatus.

Metallic glass is typically available in a thin ribbon form. U.S. Pat. No. 4,298,382 describes the ribbon as having a maximum thickness of 0.94 mm and 20–30 cm in widths of variable length. This material is available in commercial quantities for example from Allied Corporation in the United States of America (under the trademark METGLASS) and Goodfellows Ltd in Britain.

For the purposes of describing the invention, the following information represents the preferred materials and preferred methods known to the inventors at this time. There are forms of metallic glass which are not brittle and which remain pliable in the temperature range 0° C.–45° C. One example is supplied in rolls of any length having 21 cm width and a uniform thickness of 0.025 mm. The inventors have used metallic glass ribbon which is sold under the trademark METGLASS 2605TCA and available from Allied Corporation.

Rectangular or square ribbon pieces (laminations) are cut from the roll of metallic glass using conventional cutting methods. These laminations are then coated with a temperature resistant, non-gas producing metal bonding material. This bonding material is called ARALDITE F plus hardener HY905 and is available from Araldite Suppliers Sellers Atkins, Australia, or alternatively an impregnating material known by its trademarks TRA-BOND 2130 and TRA-CAST 3103 for bonding at 300° C. over five hours or TRA-BOND 2215 and F202 for operational temperatures less than 140° C. as supplied by TRA-CON INC, Medford Me., USA.

Any bonding material used should preferably withstand temperatures of at least 300° C. without changing its bonding characteristics.

However, the maximum temperature to be withstood will preferably be more than the Curie temperature but less than the crystallisation temperature of the chosen metallic glass product used.

The metallic glass laminations are bonded in ambient temperatures of between 0° C. and 45° C. The bonding material will preferably bond the metallic glass laminations without producing any gas, since, any gas trapped between the ribbon pieces creates voids which will reduce the packing density of the metallic glass laminations and consequently lower the ferromagnetic properties of the bulk object produced from the bonded metallic glass laminations and allow the laminations to separate and/or split during the cutting process.

The method of coating the laminations should be in accordance with the directions provided by the manufacturer of the bonding material. A brush was used to apply the bonding material onto the laminations in this example, but may also be applied by spraying, trickle impregnation, soaking, etc.

The coated laminations are then carefully placed, one on the other, to form a stack.

The stack may then be pressed during the recommended curing period of the bonding material. When ribbons are formed into a coiled ring, the coiling of the ribbon material can create sufficient pressure between each layer of ribbon to ensure adequate bonding.

Slight pressure may be provided by placing the stack in a press during the curing period, although other pressure application methods could be used. The amount of pressure applied is preferably less than that which would force the bonding material from between the laminations to the extent that little or no bonding material is left between the laminations.

A stack of metallic glass laminations having an appropriate shape can provide high quality ferromagnetic properties while reducing eddy currents when used in electrical apparatus such as motors, chokes and transformers, however, the stack must be cut into the appropriate shape.

In this example the rectangular or square stack is cut using an abrasive carrying fluid jet cutting machine.

Any suitable cutting mixture, such as liquid or gas mixed with an abrasive element, may be employed. The choice of fluid, abrasive and pressure is a matter of selection based on the thickness of the block to be cut and the state of the block.

FIG. 1 depicts a pictorial representation of a cut made into a solid object with a conventional cutting apparatus. For example the cutting apparatus is a water cutting machine, trade named WIZZARD 2000, available from Ingersoll-Rand, Australia. A standard nozzle would be located at 10 a distance 12 above a stack of metallic glass laminations 14 which are of thickness 16. A typical distance is 5–10 mm and a typical thickness is 10–30 mm. The flare of the cutting medium emitted from the nozzle at the underside of the stack is evidenced by a non-perpendicular surface 18 with respect to the upper lamination surface 20 of the stack. The angle of surface 18 is approximately half the total angle A of the flare of the jet of the cutting medium.

It is not desirable to have any angle on the end of the part 22. The part may, for example, be a stator of an electrical motor and an uneven cut would imbalance the electromagnetic characteristics of the part. If the rotor of an electric motor was made in this way, the rotor may be unbalanced and the spinning characteristics of the rotor would be adversely affected.

Figure 2:
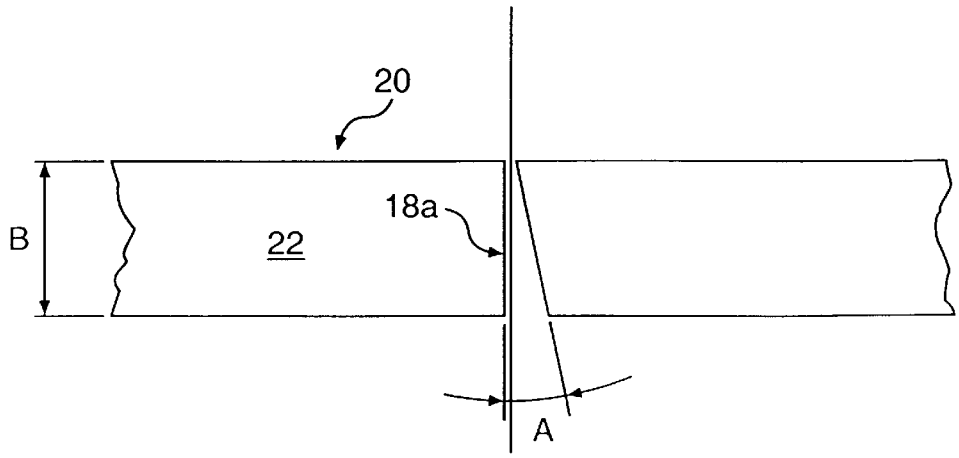
FIG. 2 is a pictorial representation of a cut made with a cutting apparatus with a nozzle angle adjustment means.

Ideally, the cutting process should produce a surface 18*a* of the part 22 which is perpendicular to the surface 20 of the stack as is pictorially depicted in FIG. 2.

The invention described herein also involves the use of an improved cutting apparatus comprising an adjustable nozzle which can be positioned so that the outer surface of the emitted cutting medium is directed along a path perpendicular to the plane of the upper surface of the stack of metallic glass laminations, having a result which is pictorially represented in FIG. 2. However, movement of the block with respect to the emitted cutting medium, will produce the same result.

Figure 3:
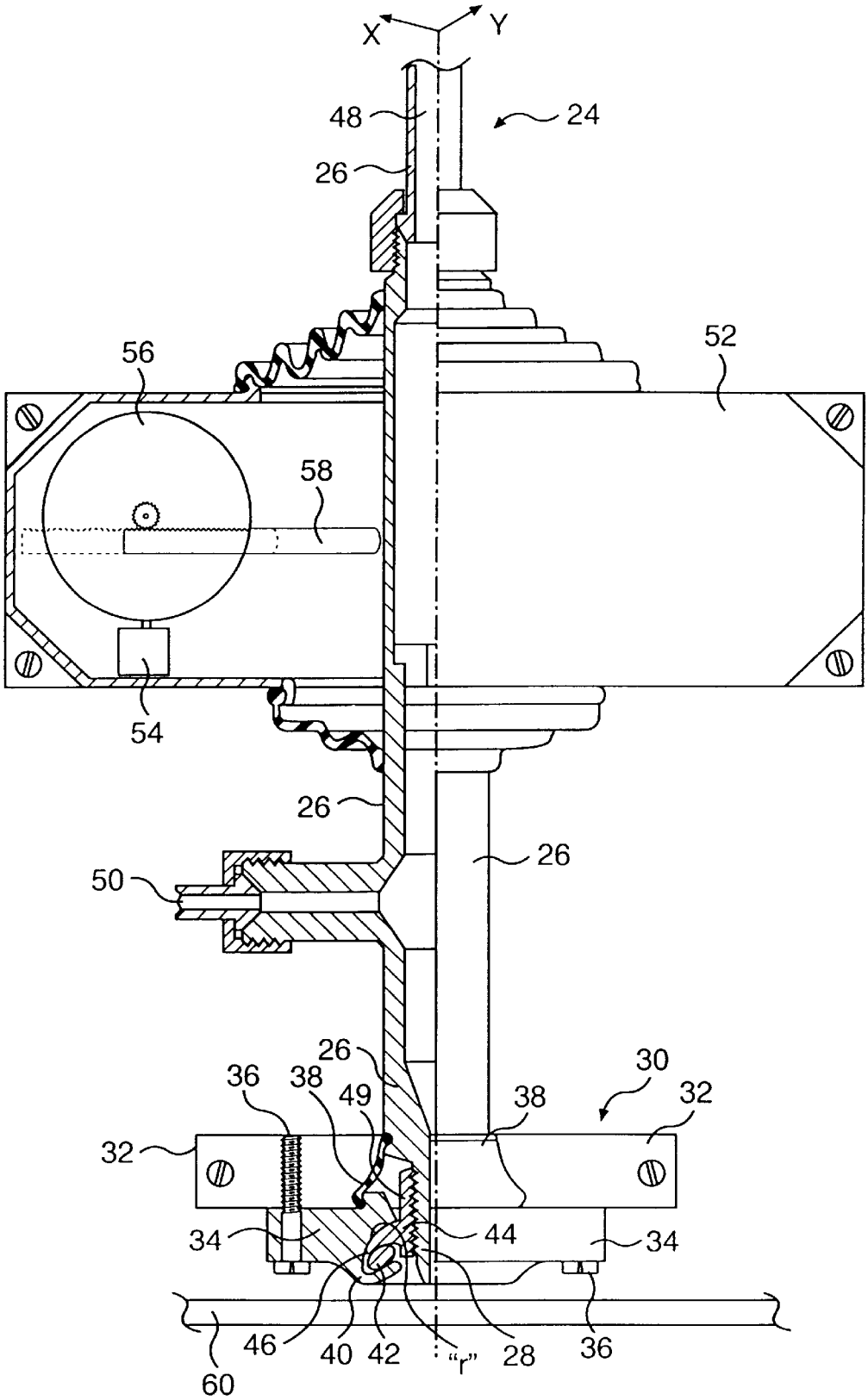
FIG. 3 is a cutting apparatus having a nozzle angle adjustment means.

FIG. 3 depicts a cutting head apparatus in partial cross-sectional view. A unitary cutting head shaft 26 of conventional arrangement is shown extending from the uppermost portion of the cutting head apparatus 24 to its lowermost portion in the vicinity of the outlet nozzle 28.

The following description provides one way in which the cutting apparatus shaft can be pivoted so as to direct the abrasive jet mixture which emits from the outlet nozzle in a manner similar to that which is depicted schematically in FIG. 2.

In this embodiment the fulcrum of the adjustment mechanism is located in the proximity of the outlet nozzle 28. While the upper portion of the cutting apparatus shaft is moved in the X and Y directions relative to the fulcrum point of the shaft.

A swivelling assembly 30 is fixed to an external framework (not shown) comprising, in this embodiment, a frame attachment member 32, a swivel mounting body 34 fixed to the attachment member by screw 36. The mounting body is sealed to the cutting apparatus shaft 26 by a flexible boot 38.

Pivoting of the shaft with respect to the swivel mounting body is achieved by providing a seat 40 upon which is located a neoprene or similar material sealing ring 42 which cushions a flange 44 mounted on the shaft 26. The flange has an arcuate surface 46 shaped so as to smoothly abut the internal arcuate surface of the swivel mounting body 34. The radius 'r' of the arcuate surface needs to be taken into consideration for accurate and sensitive control of the tilt of the shaft 26. The flange 44 is located on a threaded collar 49 which threadingly engages with the external surface of the outlet nozzle 28.

The cutting apparatus shaft 26 is of a standard nature having a high pressure fluent medium inlet coupling lead at 48 and an abrasive particles inlet nozzle at 50.

In this embodiment the control unit 52 for controlling the position of the shaft 26 is located intermediate the inlet 48 and the abrasive particles nozzle inlet 50. However, it is to be noted that this adjustment controller could be arranged at any suitable point along the shaft length above the swivel apparatus 30. The swivelling point could also be arranged at some other point along the shaft, and the control point could be adjusted accordingly.

In this embodiment the movement of the shaft by the adjustment controller is achieved by using servo-motor actuated rods which push and thereby tilt the shaft in a predetermined manner. One such servo-control mechanism is shown in FIG. 3, wherein, electronic control apparatus 54 provides control voltages to a servo-motor 56. The driven shaft of the servo-motor drives a rack and pinion mechanism which actuates the lateral movement of a rod 58 which is in abutment with a portion of the shaft 26. The shaft is tilted relative to the vertical, redirecting the flared abrasive jet mixture emitting from the outlet nozzle 28 of the cutting head.

Three such servo-controlled rod arrangements are equally radially spaced about the circumference of the shaft 26. The three rods can be controlled relative to one another to achieve the degree of tilt required. It should be realised that more than three servo-controlled rods may be used.

The magnitude of tilt required at any one particular time may be a function of the pressure, the type of abrasive material and the type of fluent medium used to project the abrasive materials onto the material being cut at that time. Furthermore, known electrostatic control means can be used to assist in controlling the amount of flaring of the mixture being emitted from the nozzle.

The electronic control apparatus 54 may comprise many different devices, eg a 3-axis stepper control system known as the SmartStep/3 available from INNOVONICS Pty Ltd, Australia. The servo-motor 56 may be of the dc linear stepper motor type, or any other suitable micro controllable motor type.

The material to be cut 60 is located in close proximity to the outlet nozzle 28 and held firmly during the cutting process, while the cutting head apparatus 24 is moved in a similar manner to that of an XY plotter so as to trace the profile of the shape to be cut in the material 60.

The cutting head has been described as being movable, but the workpiece itself may be made movable, or in some instances both parts may be movable relative to each other and a further reference point.

Figure 4:
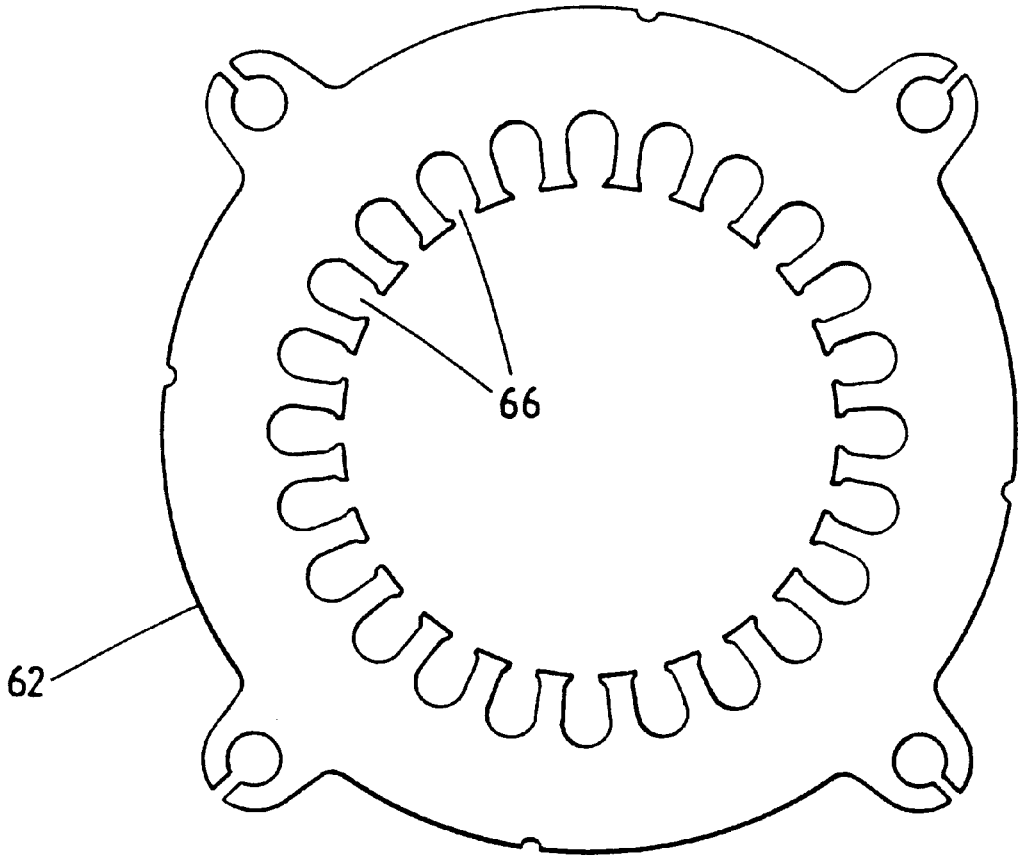
FIG. 4 is a cross-section of the shape of a metallic glass lamination cut using the nozzle adjustable cutting apparatus.

The cutting process enables any desired shape to be cut, as for example the shape which is depicted in FIG. 4. The shape depicted is a cross-section of a stacked block of metallic glass ribbons and is suitable for winding as a stator of an electric motor.

Figure 5:
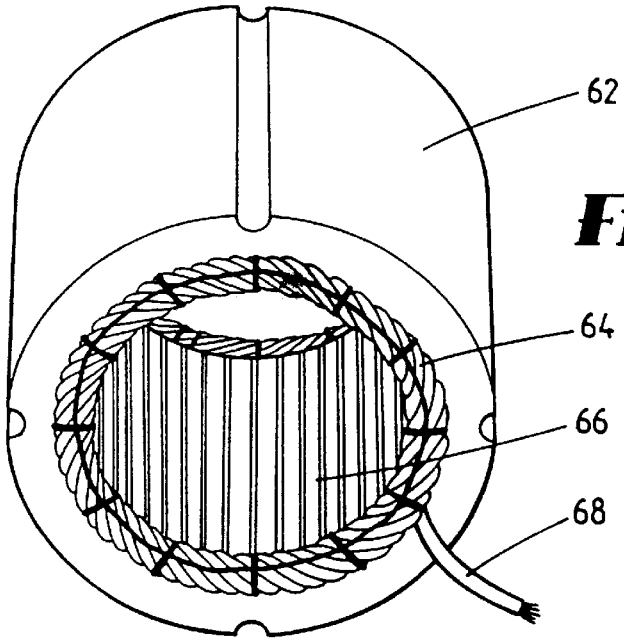
FIG. 5 is a stator of an electric motor.

FIG. 5 depicts a wound stator of an electric motor. The stator of this motor has a similar internal profile to that depicted in FIG. 4. The stator 62 has conductive wiring 64 wound in a standard manner through channels 66. The wiring terminates in a plurality of wires 68 which is, in use, connected to an electrical power source (not shown).

Figure 6:
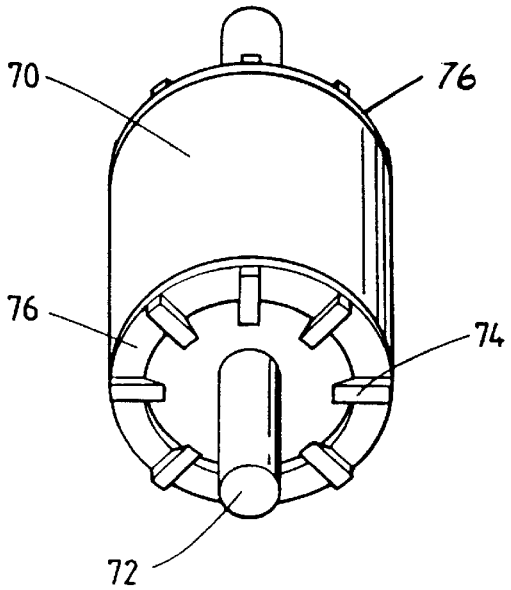
FIG. 6 is a rotor of an electric motor.

FIG. 6 depicts the rotor 70 of an electric motor of a size and shape adapted to work with the stator 62 depicted in FIG. 5. The rotor shaft 72 is the driven portion of the motor and is adapted (not shown) to provide motive force to whatever the motor is connected to. Vanes 74 may be used to act as a cooling fan element to the motor. Rings 76 of the squirrel cage rotor windings are shown in FIG. 6.

Figure 7:
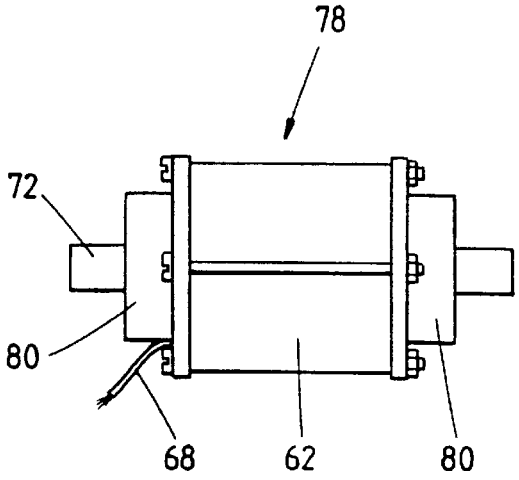
FIG. 7 is an assembled electric motor.

FIG. 7 depicts an assembled electric motor 78 comprising end plates 80, stator 62 and rotor shaft 72.

It has been found that a motor having the stator profile depicted in FIG. 4 provides similar efficiency to motors of much larger construction using other stator materials. The motor constructed by the inventors has been found to exhibit higher torque and improved responsiveness in comparison to a conventional motor of larger size and standard stator material.

The inventors have found that the motor of the embodiment has a very high power to volume ratio in comparison to conventional motors. It is understood that the improved performance of the motor is due primarily to the use of metallic glass as its stator material however the intricate and fine control of the cutting of stacked laminations of metallic glass and close winding of the requisite number of coils further enhances the performance of electric motors made of this material.

Figure 8:
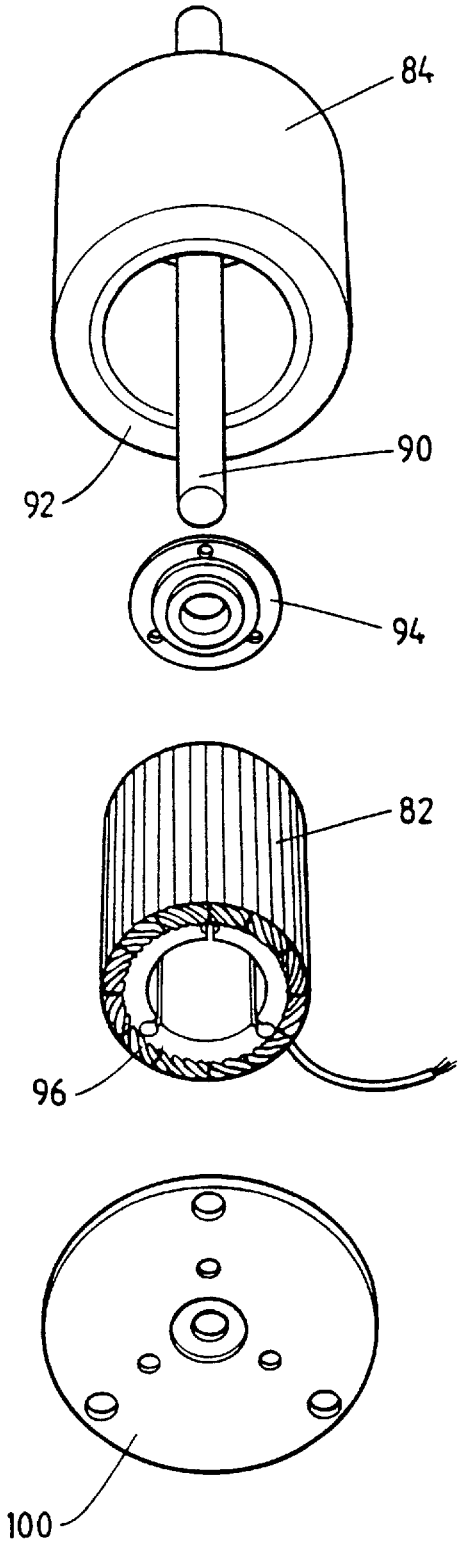
FIG. 8 is an exploded view of a cup-type electric motor.

FIG. 8 depicts an exploded view of a cup-type induction motor which uses appropriately shaped laminated metallic glass for its stator 82. The stator is very compact. However the mechanical configuration of the motor is not unlike conventional motors of this type. Therefore the following description will be known to those skilled in the art.

The external rotor 84 is coupled in this embodiment to a pulley assembly 86 of a V-type profile. A bottom bearing is not typical for cup-type motors, however, this arrangement is preferable for larger capacity motors. The pulley assembly may be of many other types including flat and sprocketted. The mounting base 88 is adapted to support the shaft 90 about which the external rotor 84 and its windings 92 are arranged.

Figure 9:
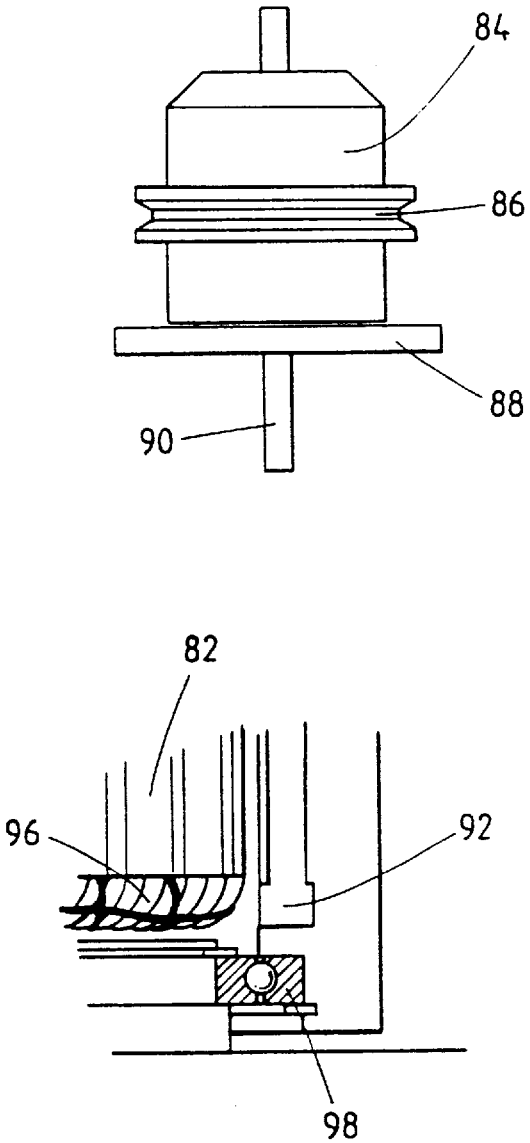
FIG. 9 is an enlarged view of the mounting base rotor bearing of the motor depicted in FIG. 8.

The bearing housing 94 is coupled to the stator 82 in a standard manner. An enlarged portion of the cup-type motor assembly is shown at FIG. 9, which depicts the stator 82, the stator windings 96 as well as the rotor windings 92. For larger capacity motors the external rotor bearings 98 are used to stabilise the rotation of the rotor. Also shown in FIG. 8 is the mounting base and bottom bearing housing 100 for the rotor shaft 90.

The assembly just described is more compact than a similarly efficient cup-type induction motor.

We also describe herein a disc-type motor, constructed using the various aspects of the invention to produce a very compact configuration. The invention allows very fine control over the final shape of the parts used in this type of motor. Metallic glass rotors and stators of various configurations are possible and in particular many different configurations are available as a direct result of their compact designs. The disc motor shown, uses a plurality of stators and rotors. A disc motor of differing torque and power characteristics can be constructed dependent on the quantity and arrangement of rotors and stators.

In this embodiment the disc-type motor comprises a rotor 102 having its windings 104 on an inner side thereof. A self centralising fixing assembly 106 is provided to fix the rotor to the shaft 108.

Figure 11:
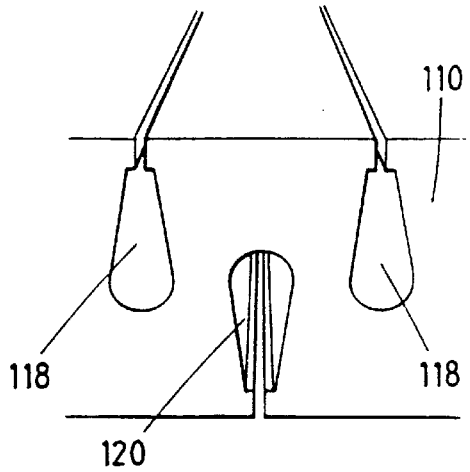
FIG. 11 is an enlarged view of a double-sided stator core.

Below and adjacent the rotor 102 is a stator 110 having a centrally located shaft bearing 112. The stator is a two-sided stator having windings 114 and 116 located in grooves 118 and 120 respectively as depicted in FIG. 11.

The grooves have been cut into a metallic glass block, and are shown intruding into the depth of the block greater than the central depth. There is, however, little detrimental effect to the operation of the windings, even though they are laterally overlapped and in close proximity to each other.

There are a variety of methods for the production of rotors and stators, one of which is to use rolls of metallic ribbon which can be accurately cut either outside to in, or inside to out, and then concentrically fitted one in another by gluing and eventually annealed.

A two-sided rotor 122 is located below and adjacent to the two-sided stator 110. The two-sided rotor 122 has a self-centralising fixing assembly 124 and windings 126 and 128 located on each side of the rotor 122.

Figure 12:
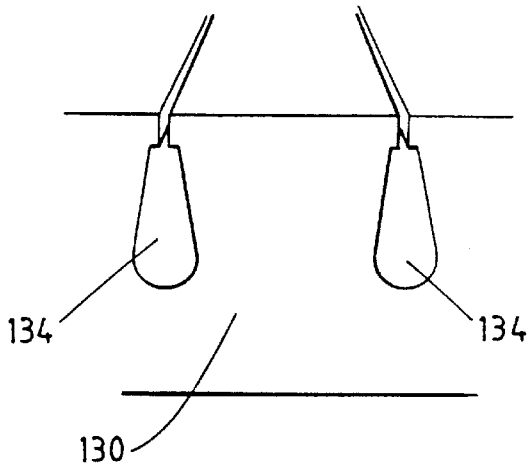
FIG. 12 is an enlarged view of a single-sided stator core.

Below and adjacent the two-sided rotor 122 is a one-sided stator 130 having a winding 132 located on an upper side thereof. As depicted in an exploded view of the one-sided stator, FIG. 12, the winding 132 is located in channels 134 which have been created in the stator material by the cutting methods described herein.

The one-sided stator also has a shaft supporting bearing 136.

Figure 10:
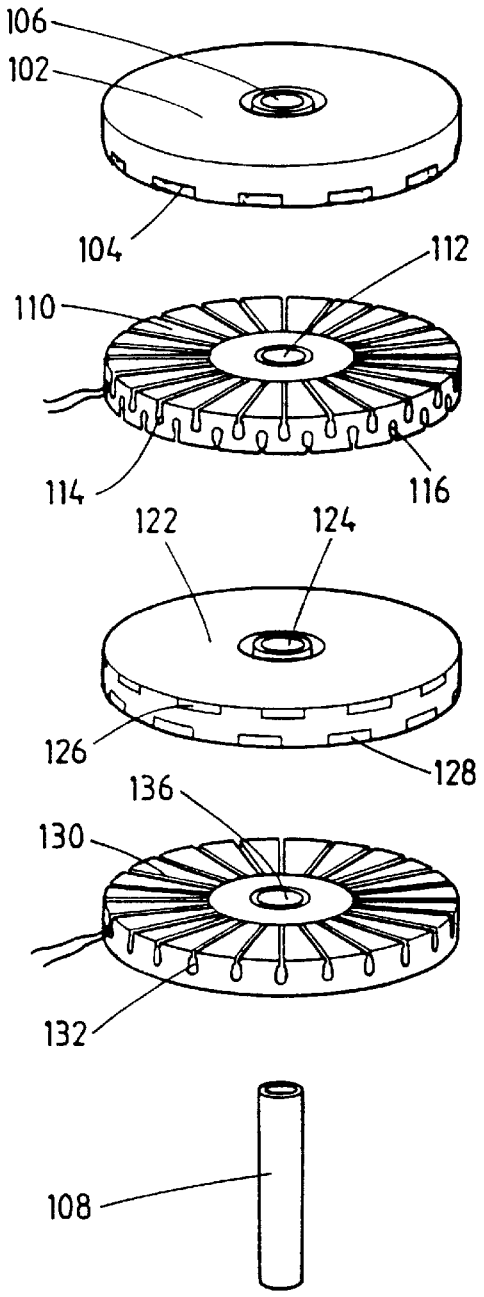
FIG. 10 is an exploded view of a disc-type electric motor.
Figure 13:
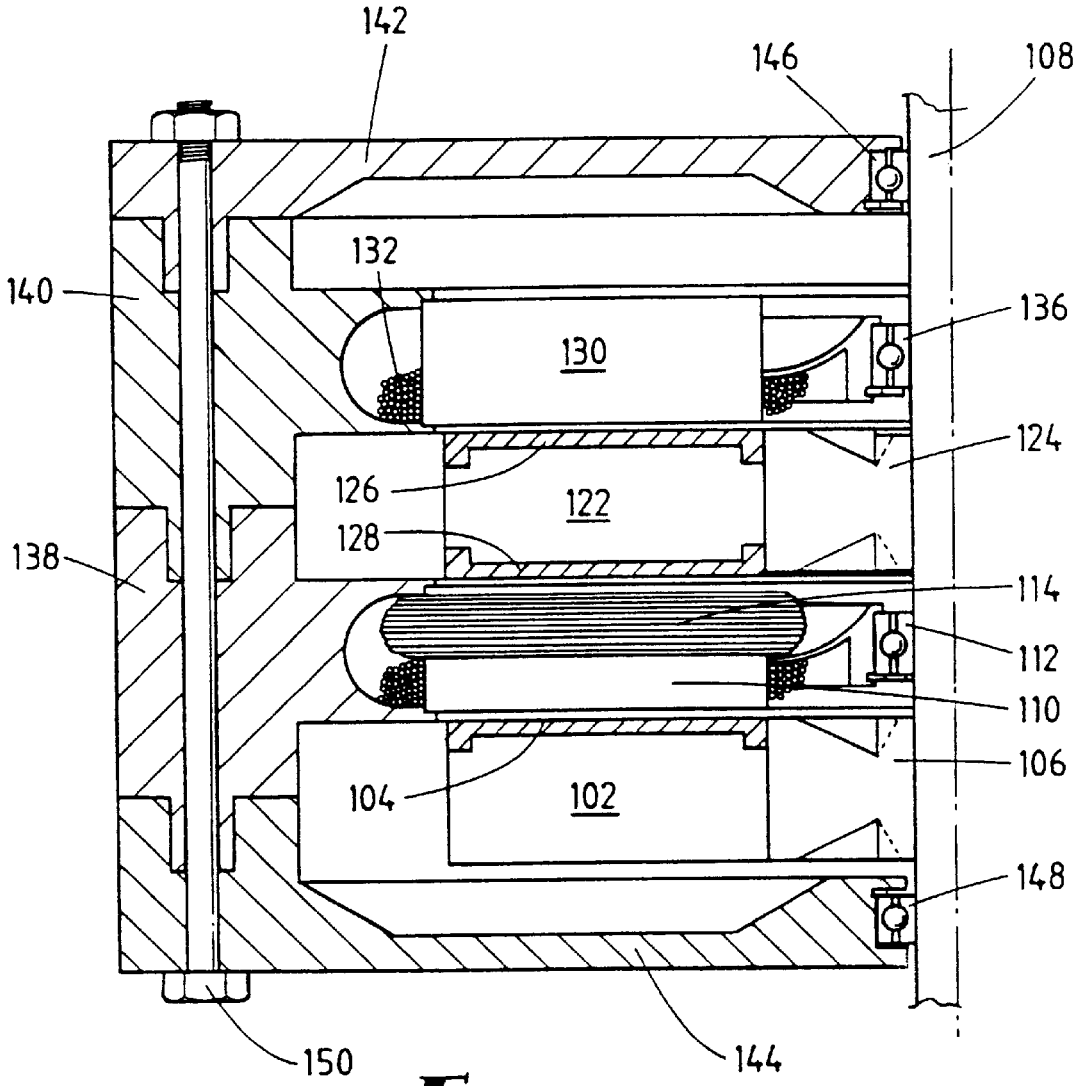
FIG. 13 is a partial cross-sectional view of an assembled disc-type electric motor.

FIG. 13 depicts a disc type motor of a slightly different configuration to that which is depicted in exploded view FIG. 10. However, like elements of FIGS. 10 and 13 will be provided like identification numbers.

In this example the disc motor comprises a lowermost one-sided rotor 102, a self-centralising fixing assembly 106 and its windings 104. Adjacent and above the one-sided rotor is a two-sided stator 110 having a shaft supporting bearing 112 and stator windings 114 and 116, as well as a stator casing 138.

Above and adjacent the two-sided stator is a two-sided rotor having a self-centralising fixing assembly 124 and windings 126 and 128.

Above the two-sided rotor 122 and adjacent thereto is a one-sided stator 130 having a shaft supporting bearing 136, a winding 132 and a stator housing 140.

The previously described stator and rotor elements are assembled and capped with end plates 142 and 144 respectively and shaft supporting bearings 146 and 148 provide further stability for the rotation of the shaft by the rotor elements. The assembly bolt 150 as depicted is but one of the bolts holding the motor in the motor assembly depicted in FIG. 14.

Figure 14:
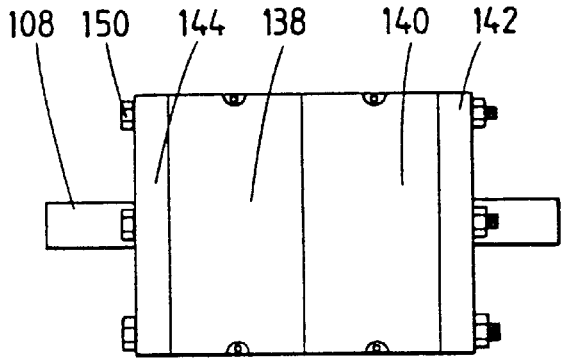
FIG. 14 is an external view of a disc-type electric motor.

FIG. 14 shows an assembled disc-type motor.

This type of configuration of elements 130, 122, 102, 142, 150 provides flexibility in that the size of a motor can be changed by adding or removing one or more of the stators and rotor and using a shaft of appropriate length. This modular type of design is very flexible for users.

As is applicable to the stators of all the previously described motors the shaped stacks of metallic glass laminations are fitted with wiring and insulation and heated to a temperature sufficient to anneal the laminated metallic glass into a stator assembly.

Figure 15:
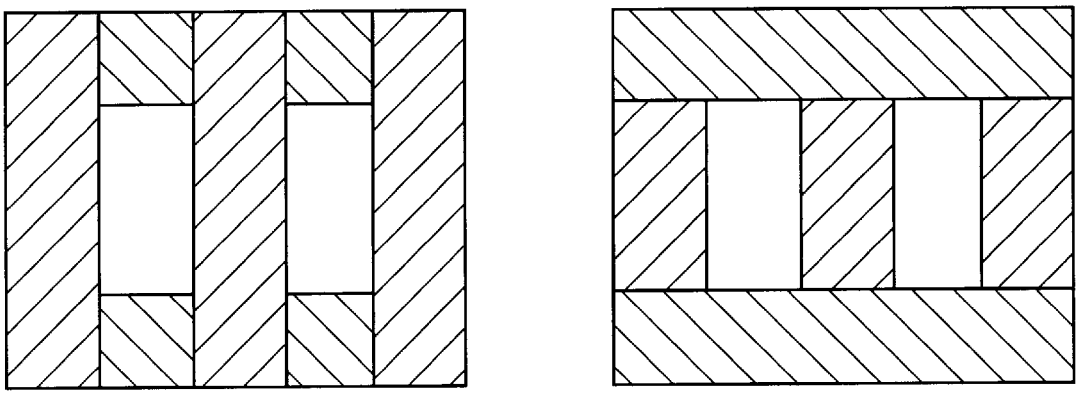
FIG. 15 PRIOR ART
FIG. 15 is a conventional E| type transformer core.

As previously mentioned the manufacture of metallic glass cores for variously shaped transformers has been achieved using blocks of laminated metallic glass ribbons arranged as depicted in FIG. 15. The first layer is shown as comprising seven blocks and the second layer is overlaid by a layer of five blocks and these portions of the transformer core therefore have eight and six gaps respectively. The first and second layers are then repeated one on the other to the required height. Discontinuities of the magnetic flux caused by the gaps between blocks lessen the otherwise favourable electromagnetic properties of the metallic glass material and the rating of the transformer is undesirably reduced.

Figure 16:
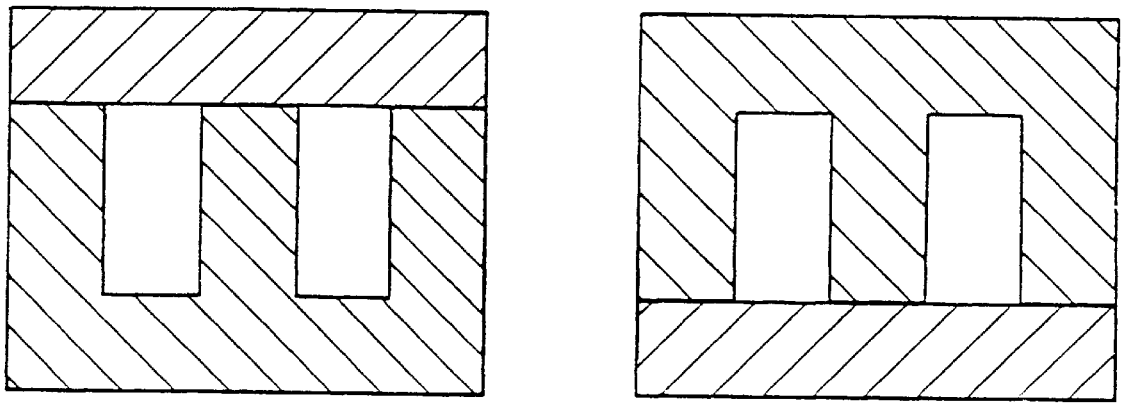
FIG. 16 is a solid E| type transformer core.

Using a suitably large bulk shape of laminated metallic glass ribbon the cutting apparatus described herein can cut the block into a suitable shape and provide thereby fewer blocks which make up the first and second layer creating only three gaps as depicted in FIG. 16. Variously shaped transformers can be constructed as well as various arrangements of blocks in each shape may be possible because of the flexibility of the cutting technique provided by the invention.

The transformer windings in the required ratios of desired wire thickness can be wound and either the whole transformer can be heat annealed in the manner described or the windings can be used to electromagnetically heat the core to achieve the desirable annealed state. The latter technique is particularly desirable when the size of the transformer does not fit into conventional kilns and other like heating environments for annealing the transformer core. Kiln heating is to be avoided if possible, since the cores become very fragile after annealing and thereby very prone to damage during transportation.

Figure 17:
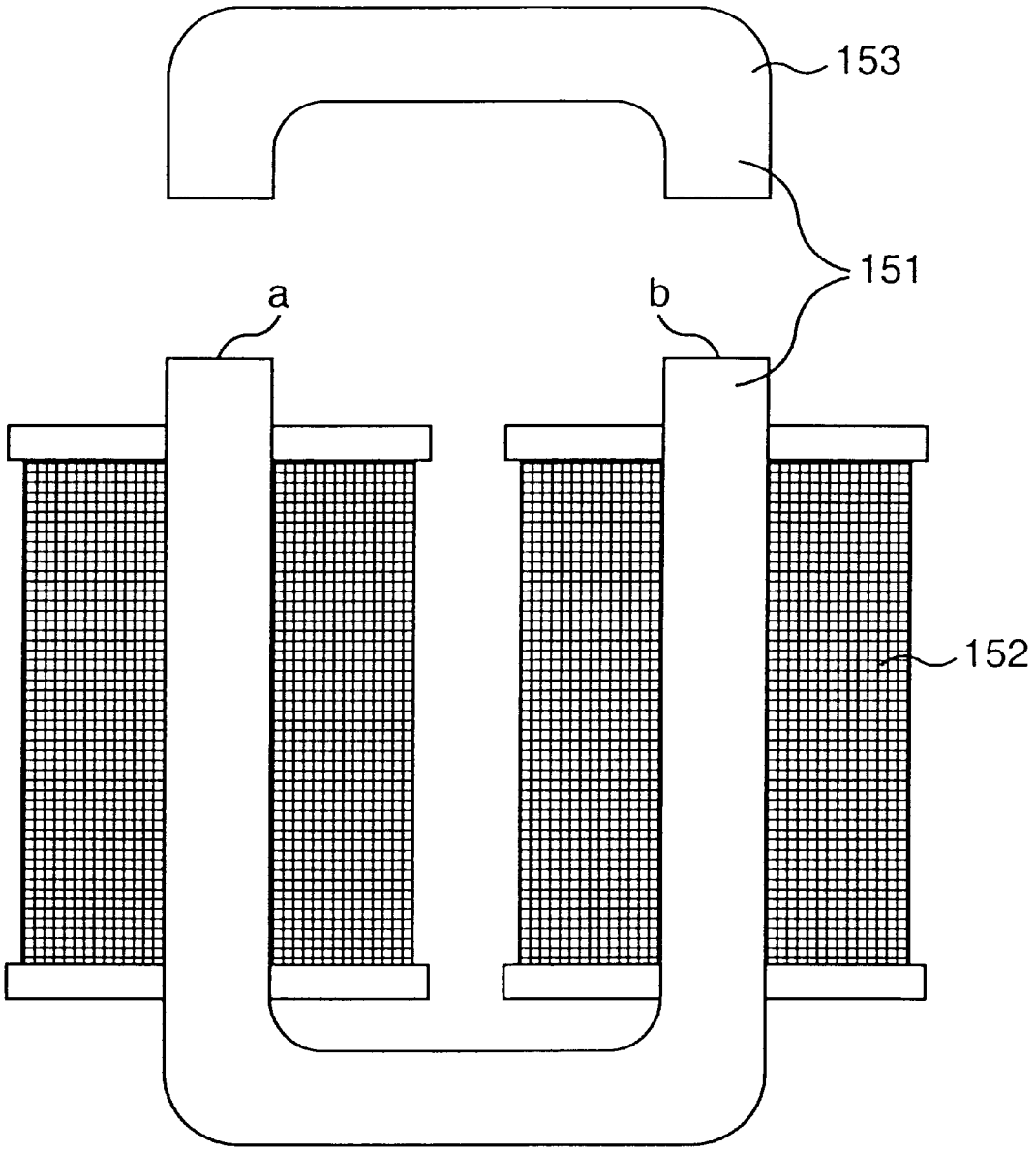
FIG. 17 shows a toroidal type transformer core.

This applies also to toroidal transformers as shown in FIG. 17 where core 151 which is also made of a metallic glass, is cut at two places a, b, equipped with coils 152 and closed with bridging part 153.

We claim:

1. A cutting apparatus for cutting a planar material, said apparatus comprising:

a body having means for mixing a fluent material with an abrasive material forming a jet cutting mixture;

an emission nozzle from which emissions of said cutting mixture occurs, said nozzle being located at an end of said body adjacent said planar material, a swivel assembly located on said body enabling radial translation of said body relative to a stationary framework, and adjustment means for adjusting and maintaining said body into relative position and angularity between said planar material and said nozzle so that emissions of said cutting mixture forms a predetermined flare that effectuates orthogonal cut edges in said planar material.

2. A metallic glass cutting apparatus according to claim 1 wherein three or more rods are equally radially spaced about said body.

3. The cutting apparatus according to claim 2, wherein said servo-actuated means is a stepper motor.

4. The cutting apparatus according to claim 1, wherein said adjustment means includes means for controlling directionality of said nozzle in response to variations in said predetermine flare of said mixture.

5. The cutting apparatus according to claim 1, wherein said planar material comprises metallic glass.

6. The cutting apparatus according to claim 1, wherein said swivel assembly comprises a frame attachment member adapted to attach to a stationery framework, said frame attachment member connects to a swivel mounting body having a flexible member that controls the orientation of said nozzle.

7. A cutting apparatus for cutting a planar material, said apparatus comprising:

a body having means for mixing a fluent material with an abrasive material forming a jet cutting mixture;

an emission nozzle from which emissions of said cutting mixture occurs, said nozzle being located at an end of said body adjacent said planar material, a swivel assembly located on said body enabling radial translation of said body relative to a stationary framework, and adjustment means for adjusting and maintaining said body into relative position and angularity between said planar material and said nozzle so that emissions of said cutting mixture forms a predetermined flare that effectuates orthogonal cut edges in said planar material, wherein said adjustment means includes means for controlling directionality of said nozzle in response to variations in said predetermined flare of said mixture, said means for controlling directionality of said nozzle includes at least one rod, each said rod being equiangularly spaced about a shaft, a first end of each said rod abuts said shaft and a second end of each said rod translates radially by a servo-actuated means for positioning said shaft.

8. The cutting apparatus according to claim 7, wherein said planar material comprises metallic glass.

9. A method for cutting orthogonal edges in planar material, the method comprising:

providing a cutting apparatus having means for forming a jet cutting mixture, an emission nozzle from which emissions of said cutting mixture occurs, a swivel assembly attaches to said cutting apparatus that includes adjustment means for adjusting and maintaining relative position and angularity between said planar material and said nozzle so that emissions of said cutting mixture forms a predetermined flare that effectuates cut orthogonal edges in said planar material;

affixing said planar material to said cutting apparatus for said cutting method;

programming said apparatus to cut a predetermined pattern in said planar material; and emitting said cutting mixture while moving said planar material with respect to said nozzle in said predetermined pattern.

10. The method according to claim 9, wherein said method is for the cutting of planar metallic glass material.

11. The method according to claim 10, wherein said method is for cutting electric motor stator ribbons.

12. The method according to claim 10, wherein said method is for cutting transformer core ribbons.

13. The method according to claim 10, wherein said method is for cutting electric motor rotor ribbons.

* * * * *